US008484862B2

(12) United States Patent
Nawrot et al.

(10) Patent No.: US 8,484,862 B2
(45) **Date of Patent: *Jul. 16, 2013**

(54) CONDENSATION DRYER WITH A HEAT PUMP AND RECOGNITION OF AN IMPERMISSIBLE OPERATING STATE AND METHOD FOR THE OPERATION THEREOF

(75) Inventors: Thomas Nawrot, Berlin (DE); Ulrich Nehring, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 364 days.

This patent is subject to a terminal disclaimer.

(21) Appl. No.: 13/056,426

(22) PCT Filed: Jul. 28, 2009

(86) PCT No.: PCT/EP2009/059730

§ 371 (c)(1),
(2), (4) Date: Jan. 28, 2011

(87) PCT Pub. No.: WO2010/012723

PCT Pub. Date: Feb. 4, 2010

(65) Prior Publication Data

US 2011/0178653 A1 Jul. 21, 2011

(30) Foreign Application Priority Data

Aug. 1, 2008 (DE) ..... 10 2008 040 946

(51) Int. Cl.
*F26B 3/00* (2006.01)

(52) U.S. Cl.
USPC ..... 34/381; 165/287; 62/285

(58) Field of Classification Search
USPC ..... 318/381, 468, 595, 601, 606, 610; 68/20, 68/28; 165/43, 287; 60/525, 651
See application file for complete search history.

(56) References Cited

U.S. PATENT DOCUMENTS

| | | | | |
|---|---|---|---|---|
| 2,713,995 | A * | 7/1955 | Arkoosh et al. | 165/258 |
| 3,734,810 | A * | 5/1973 | Davis | 165/240 |
| 6,158,148 | A | 12/2000 | Krausch | |
| 6,321,460 | B1 * | 11/2001 | Jin | 34/77 |
| 6,904,703 | B2 * | 6/2005 | Naganawa et al. | 34/596 |
| 7,055,262 | B2 * | 6/2006 | Goldberg et al. | 34/86 |

(Continued)

FOREIGN PATENT DOCUMENTS

| | | | |
|---|---|---|---|
| DE | 2917230 | A1 | 11/1979 |
| DE | 4304226 | A1 | 8/1994 |

(Continued)

*Primary Examiner* — Kidest Bahta
(74) *Attorney, Agent, or Firm* — James E. Howard; Andre Pallapies

(57) ABSTRACT

A condensation dryer having a temperature sensor to measure a temperature of a coolant; a first comparator to determine a temperature difference between a first temperature of the coolant and a second temperature of the coolant that is measured after a period of time and to compare the temperature difference with a limiting temperature difference stored in a controller; a counter to ascertain a number of occurrences in which the temperature difference is greater than or equal to the limiting temperature difference; and a second comparator to compare the number of occurrences with a limiting number stored in the controller and to evaluate a number difference between the number of occurrences and the limiting number with respect to the presence of an impermissible operating state. A first impermissible operating state is indicated if the number difference is greater than or equal to a value stored in the controller.

13 Claims, 5 Drawing Sheets

U.S. PATENT DOCUMENTS

| | | | | |
|---|---|---|---|---|
| 2005/0246920 | A1 | 11/2005 | Yabuuchi et al. | |
| 2005/0262720 | A1* | 12/2005 | Rane et al. | 34/330 |
| 2007/0107255 | A1 | 5/2007 | Tamura et al. | |
| 2009/0165328 | A1* | 7/2009 | Grunert et al. | 34/443 |
| 2010/0011615 | A1* | 1/2010 | Steiner | 34/493 |
| 2010/0146809 | A1* | 6/2010 | Grunert et al. | 34/443 |
| 2011/0173838 | A1* | 7/2011 | Nawrot et al. | 34/468 |
| 2011/0209357 | A1* | 9/2011 | Ediger et al. | 34/595 |

FOREIGN PATENT DOCUMENTS

| | | | |
|---|---|---|---|
| DE | 4409607 | A1 | 10/1994 |
| DE | 19704213 | C1 | 9/1998 |
| DE | 4023000 | C2 | 2/2003 |
| DE | 10255575 | C1 | 12/2003 |
| EP | 0997571 | A2 | 5/2000 |
| EP | 1790769 | A1 | 5/2007 |
| EP | WO2008086933 | A1 | 7/2008 |

* cited by examiner

CONDENSATION DRYER WITH A HEAT PUMP AND RECOGNITION OF AN IMPERMISSIBLE OPERATING STATE AND METHOD FOR THE OPERATION THEREOF

BACKGROUND OF THE INVENTION

The invention relates to a condensation dryer having a heat pump and with detection of an impermissible operating state, and to a preferred method for operating the dryer.

In a condensation dryer, air (what is termed process air) is ducted by a fan across a heater into a drum as a drying chamber containing damp laundry items. The hot air absorbs moisture from the laundry items requiring to be dried. Having passed through the drum, the then moist process air is ducted into a heat exchanger upstream of which as a rule a lint filter is connected. The moist process air is cooled in said heat exchanger (for example an air-air heat exchanger or a heat pump's heat sink) so that the water contained in the moist process air condenses. The condensed water is then generally collected in a suitable container and the cooled and dried air ducted back to the heater (which may be a heat pump's heat source) and then to the drum.

That drying process is in certain circumstances very energy-intensive because the cooling-air current heated in the heat exchanger as the process air is cooled can in energy terms be lost to the process. That energy loss can be significantly reduced by employing a heat pump. In the case of a condensation dryer fitted with a heat pump the warm, moisture-laden process air is cooled substantially in a heat sink of the heat pump, where the heat extracted from the process air is used for, for example, evaporating a coolant employed in the heat-pump circuit. The heat absorbed in the heat sink is transported inside the heat pump to the heat source and there given off again—possibly at a temperature raised above that at the heat sink. In a heat pump, which operates with a coolant as the heat-transporting means, with the coolant being evaporated in the heat sink and condensed in the heat source, via a compressor the evaporated, gaseous coolant reaches the heat source, which can here be designated a condenser, where, owing to the gaseous coolant's being condensed, heat is released that is used for heating the process air before it enters the drum. The condensed coolant finally flows back to the evaporator through a throttle; the throttle serves to reduce the internal pressure in the coolant so it can evaporate in the evaporator with heat again being absorbed. The heat pump that is operated in such a way with a circulating coolant is known also as a "compressor heat pump". Other heat-pump designs are also known.

DE 40 23 000 C2 discloses a laundry dryer that has a heat pump and arranged in which in the process-air duct between the condenser and evaporator is an incoming-air orifice that can be sealed with a controllable sealing device.

DE 197 28 197 A1 discloses a method for detecting unacceptable operating conditions in a laundry dryer as well as a corresponding laundry dryer. The aim of the method is to enable separate or joint recording of different operating conditions of too high temperature that originate in different regions. The temperature is recorded periodically in the supply-air current above a supply-air heater and before the laundry drum, a difference value or gradient is created from two successively recorded values, said difference value (gradient) is compared with a preset difference value (gradient), with—if the newly created difference value is greater in absolute terms than the preset difference value—a counting value being raised by a step, said value being compared with a preset value, and—if the current value is greater than the preset value—the laundry-dryer heater being switched off and/or an operating-condition display activated.

WO 2008/086933 A1 discloses a condensation dryer having a drying chamber, a process-air circuit in which a heater for heating the process air is located and the heated process air can be ducted across the items requiring to be dried by means of a fan, an air-air heat exchanger, and a heat-pump circuit having an evaporator, a compressor, and a condenser. Located in the heat-pump circuit between the condenser and evaporator is an additional heat exchanger that is functionally coupled to the air-air heat exchanger. The temperature of the heat pump's coolant, particularly in the condenser, is kept within the permissible range via the heat pump's controller and the additional heat exchanger. Temperature sensors are furthermore employed for regulating the temperature of the coolant or heat pump and the temperature of the process air in the heat-pump circuit and/or process-air circuit.

DE 29 17 230 A1 describes a method for controlling the operation of a drying apparatus having a drum for drying an article, with which method a desired degree of dryness to be attained by means of the apparatus for the article requiring to be dried is programmed, a multiplicity of temperatures of the heated air entering the drum and of the moisture-laden air leaving the drum is registered, a maximum temperature difference between the temperatures of the heated air and the temperatures of the moisture-laden air is determined during each drying cycle of the apparatus, and as a function of the maximum temperature difference and the programmed degree of dryness for the article a final temperature difference between the temperatures is derived that is a measure of the programmed degree of dryness, and the machine function is switched off when the final temperature difference is present.

EP 1 593 770 A2 describes a clothes dryer having a drying chamber, a heat-pump mechanism in which a coolant can circulate between a heat absorber, a compressor, a throttle unit, and a heat radiator, and an air circulation path for circulating drying air from the drying chamber through the heat absorber and heat radiator back to the drying chamber. An air discharge part is located in the air circulation path between the drying chamber and heat absorber so that a part of the drying air flowing along the air circulation path from the drying chamber to the heat absorber will be conveyed to the outside through the air emptying part. In the embodiment variant of the laundry dryer shown in FIG. 10 the temperature of the coolant is measured and regulated in such a way as to keep within a prespecified range.

The traditionally employed air-air heat exchanger—operated in crossover or counterflow mode—and the electric heater are generally completely replaced with a heat pump. Compared with a dryer having an air-air heat exchanger and a resistance heater it is possible thereby to achieve a 20-50% reduction in the energy required for a drying process.

A compressor-heat pump as a rule operates optimally within specific temperature ranges in the evaporator and the condenser. What is problematic about using a compressor-heat pump in the condensation dryer is the usually high temperature in the condenser, which for process reasons can result in its no longer being possible to condense or fully condense the coolant; the compressor will then have to be switched off and/or a substantial impairment in the heat pump's effectiveness will have to be accepted. That problem is even worse when the compressor is supported by an additional heater in the process-air circuit to achieve faster heating of the process air and hence shorter drying times. Moreover, the circulating process air can be impeded by soiled air paths. That can likewise cause the temperature of the coolant to rise.

Operating states of such kind can result in damage to the heat pump or other parts of the dryer and so are impermissible.

In a conventional dryer an impermissible operating state, for example a reduced circulation of the process air (reduction in air performance) is ascertained by registering a temperature in the process-air current above a heater for the process air and in front of the drying chamber at regular intervals and forming from in each two successively registered values a difference value corresponding to a time gradient. That information generally does not have to be available in that form in the case of a dryer fitted with a heat pump (a heat-pump dryer). For example in a heat-pump dryer the heat pump is frequently sited further from the drying chamber than is the heater in a conventional condensation dryer. In any event, an impermissible operating state in a condensation dryer fitted with a heat pump can only be detected imprecisely in that way.

BRIEF SUMMARY OF THE INVENTION

The object of the invention was hence to provide both a condensation dryer having a heat pump and a method for operating said dryer whereby an impermissible operating state can be detected in a simple manner.

Said object is achieved according to the present invention by means of a condensation dryer having the features as set out in the corresponding independent claim and by means of the method as set out in the corresponding independent claim. Preferred embodiment variants of the inventive condensation dryer and of the inventive method are listed in corresponding dependent claims. Preferred embodiment variants of the inventive method correspond to preferred embodiment variants of the inventive condensation dryer and vice versa, even if that is not explicitly stated herein.

The subject matter of the invention is hence a condensation dryer having a drying chamber for the items requiring to be dried, a process-air circuit, a first fan in the process-air circuit, a heat pump in which a coolant circulates and that has an evaporator, a compressor, a condenser, and a throttle, and further having a temperature sensor for measuring a temperature of the coolant, and a controller, with the condensation dryer including first means for determining a temperature difference $\Delta T=(T_K^1-T_K^2)$ between a first temperature $T_K^1$ of the coolant and a second temperature $T_K^2$ of the coolant measured after a period of time $\Delta t_1$ and for comparing $\Delta T$ with a limiting temperature difference $\Delta T_K^{lim}$ stored in the controller; a counting device for ascertaining a number n of cases in which $\Delta T$ is greater than or equal to $\Delta T_K^{lim}$, and second means for comparing the number n with a prespecified limiting number $n_{lim}$ stored in the controller and for evaluating the difference $\Delta n=(n-n_{lim})$ with respect to the presence of an impermissible operating state.

The term "impermissible operating state" employed herein is to be given a broad interpretation. What is meant by it is any operating state that can result in an adverse effect on a drying process and/or damage to the condensation dryer.

When a condensation dryer is operating, a temperature difference $\Delta T$ may by chance happen to exceed the limiting temperature difference $\Delta T_K^{lim}$, which is to say without that event being due to an impermissible operating state of the dryer. Inventively it is therefore advantageous to exclude the influence of such events if an impermissible operating state is ascertained.

In a preferred embodiment variant of the invention the second means will therefore reset the number n ascertained by the counting device to zero if the condition $\Delta n \geqq 0$ is not met within a period of time $\Delta t_2$ prespecified in the controller.

In a preferred embodiment variant of said condensation dryer the temperature sensor is located on the outlet of the condenser or on the outlet of the compressor.

It is moreover preferred for an additional heat exchanger to be located in the heat pump in the inventive condensation dryer. In a preferred embodiment variant the additional heat exchanger is therein located in a process-air duct between the evaporator and condenser. In an alternative preferred embodiment variant the additional heat exchanger is located in a cooling-air duct. Preferably an air-air heat exchanger is located in said cooling-air duct.

The inventive condensation dryer moreover preferably includes a second fan for cooling the heat-pump circuit. The second fan is located preferably in a cooling-air duct and/or in the vicinity of the compressor.

The inventive condensation dryer preferably has an acoustic and/or visual display means for displaying an impermissible operating state. A visual display means can be, for example, a liquid-crystal display on which specific requests or advisories are indicated. It is additionally or alternately possible for light-emitting diodes to shine in one or more colors. The manner in which an impermissible operating state is displayed can be dependent on the type of impermissible operating state.

In the case of a generally less critical first impermissible operating state a request to clean the air paths in the condensation dryer could be indicated on, for example, a liquid-crystal display. Alternatively or additionally thereto a light-emitting diode could shine in the color "orange" for example.

In the case of a second impermissible operating state that is as a rule critical, an advisory that the drying process has been interrupted and the coolant circuit should be checked and/or a service engineer engaged could be indicated on, for example, a liquid-crystal display. Alternatively or additionally thereto a light-emitting diode could shine in the color "red" for example.

An acoustic indicator could also serve the purpose of a display, with its being possible for different impermissible operating states to be indicated by means of different bleep tones.

The process air can be heated exclusively via the heat pump's condenser. An electric heater can, though, also be used in addition.

If a further heater is used in the inventive condensation dryer alongside the heat pump, then it is preferably a two-stage heater. Said heater's controller is in a preferred embodiment variant of the invention likewise employed for regulating the temperature of the coolant.

The invention relates also to a method for operating a condensation dryer having a drying chamber for the items requiring to be dried, a process-air circuit, a first fan in the process-air circuit, a heat pump in which a coolant circulates and that has an evaporator, a compressor, a condenser, and a throttle, and further having a temperature sensor for measuring a temperature of the coolant, and a controller, with the condensation dryer including first means for determining a temperature difference $\Delta T=(T_K^1-T_K^2)$ between a first temperature $T_K^1$ of the coolant and a second temperature $T_K^2$ of the coolant measured after a period of time $\Delta t_1$ and for comparing $\Delta T$ with a limiting temperature difference $\Delta T_K^{lim}$ stored in the controller; a counting device for ascertaining a number n of cases in which $\Delta T$ is greater than or equal to $\Delta T_K^{lim}$, and second means for comparing the number n with a prespecified limiting number $n_{lim}$ stored in the controller and for evaluating the difference $\Delta n=(n-n_{lim})$ with respect to the presence of an impermissible operating state, with the method having the steps:

(a) Determining a temperature difference $\Delta T=(T_K^1-T_K^2)$ between a first temperature $T_K^1$ of the coolant and a second temperature $T_K^2$ for the coolant measured after a period of time $\Delta t_1$ using the temperature sensor;

(b) Comparing $\Delta T$ with a limiting temperature difference $\Delta T_K^{lim}$ stored in the controller;

(c) Incrementing the number n in the counting device by the value "1" if $\Delta T$ is greater than or equal to $\Delta T_K^{lim}$;

(d) Comparing the number n with a prespecified limiting number $n_{lim}$ stored in the controller; and (e) Evaluating the difference $\Delta n=(n-n_{lim})$ with respect to the presence of an impermissible operating state.

In a preferred embodiment variant of said method a first impermissible operating state will be displayed if $\Delta n$ is greater than or equal to $n^1$, where $n^1$ is a prespecified value stored in the controller. It is therein preferred for the display of a first impermissible operating state to include the request to clean the air paths in the condensation dryer.

In another preferred embodiment variant of the invention a second impermissible operating state will be displayed if $\Delta n$ is greater than or equal to $n^2$, where $n^2$ is a prespecified value stored in the controller. Apart from a second impermissible operating state being displayed it is preferred in this case for a drying process in progress to be interrupted.

What applies is that $n^2$ is generally greater than $n^1$.

For regulating the temperature of the heat pump's coolant a cooling device for the heat pump can be used that preferably includes a second fan. The second fan can be used directly for cooling components of the heat pump, particularly the compressor. The second fan and an additional heat exchanger are, though, preferably located in a cooling-air duct, with the additional heat exchanger being located in the heat pump. Yet a further air-air heat exchanger can be located in the cooling-air duct. The possibly present air-air heat exchanger is preferably detachable. That is particularly advantageous because a detachable heat exchanger can be more easily cleaned of lint.

It is inventively preferred for process air and cooling air or, as the case may be, process air and coolant in the heat pump to be ducted through the corresponding heat exchangers in each case by a crossover or counterflow method.

The coolant employed in the heat-pump circuit has preferably been selected from the group consisting of propane, carbon dioxide, and fluorinated hydrocarbon compounds. Particular candidates are the known coolants R134a, R152a, R407C, and R410A.

Alongside an evaporator, condenser, and compressor the heat pump in the inventive condensation dryer has a throttle in the coolant's flow direction between the evaporator and condenser; said throttle can be in particular an expansion valve (referred to also as a throttle valve), a capillary, or a restrictor.

The coolant employed in the heat pump circulates preferably with a turbulent flow. A turbulent flow can be set by means of a suitably designed embodiment of a flow duct and/or by suitable drive means (for example a compressor).

The temperature of the heat pump's coolant, particularly in the condenser, is inventively generally kept within the permissible range via the heat pump's controller and possibly an additional heat exchanger. If the inventive condensation dryer has an additional heater in the process-air circuit in front of the entrance to the drying chamber, the heat pump's control will preferably be coordinated with that of the heater.

With less and less energy being needed for drying as the degree of dryness of the items requiring to be dried in the condensation dryer increases, it is expedient to regulate the heater accordingly, which is to say to reduce its heating power in line with the increasing degree of dryness in order to maintain a balance between the drying energy supplied and that which is necessary.

As the degree of dryness of the items requiring to be dried, particularly laundry, increases, a lower heating power or even an increasing cooling power of the heat pump will hence be required. In particular the temperature in the process-air circuit would rise sharply after a completed drying phase. The heat pump and, where applicable, an additional heater in the condensation dryer is hence in general regulated in such a way that a maximum permissible temperature will not be exceeded in the drying chamber.

The invention has the advantage that a condensation dryer's operation can be monitored simply and effectively. Impermissible operating states can be reliably displayed so that suitable countermeasures can be taken. The heat pump and particularly its condenser are able to operate within an optimum temperature range. That enables the condensation dryer to operate with a particularly favorable energy balance. The heat pump will also be protected.

BRIEF DESCRIPTION OF THE DRAWINGS

Further details of the invention emerge from the following description of non-limiting exemplary embodiments of the inventive condensation dryer and a method employing said condensation dryer. Reference is therein made to FIGS. 1 to 5.

DETAILED DESCRIPTION OF EXEMPLARY EMBODIMENTS OF THE PRESENT INVENTION

Figure 1:
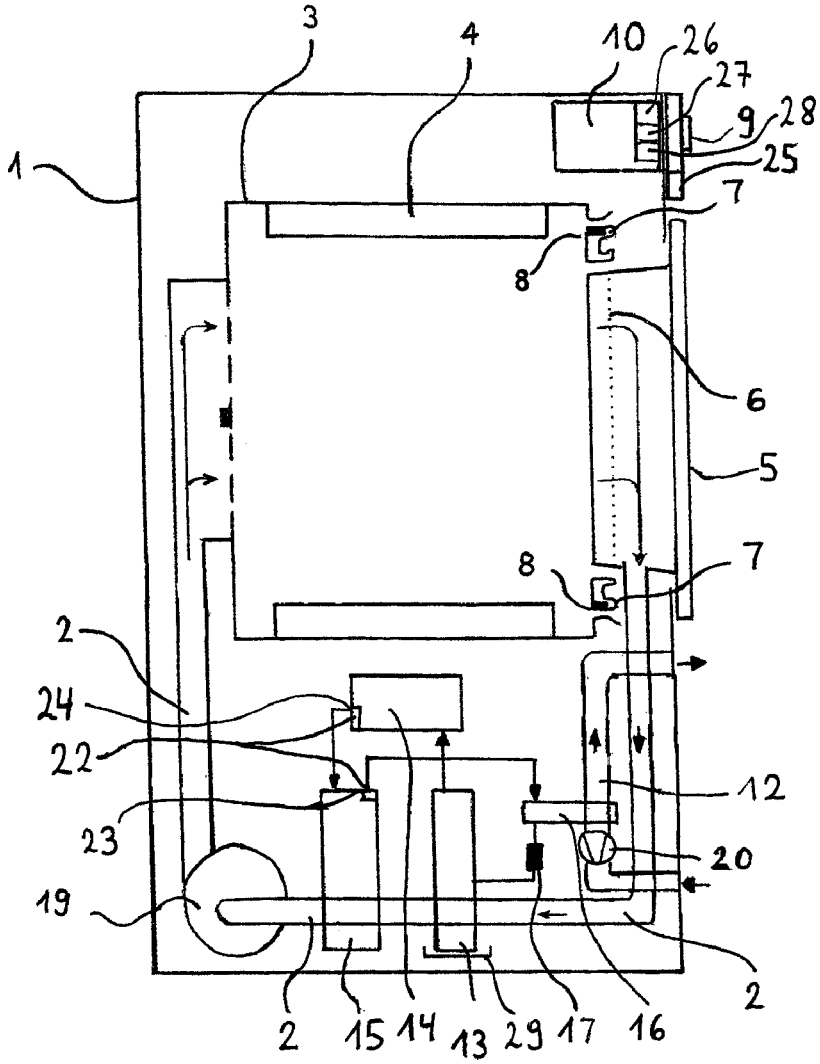
FIG. 1 shows a vertical section through a condensation dryer according to a first embodiment variant.

FIG. 1 shows a vertically sliced condensation dryer (abbreviated in the following to "dryer") according to a first embodiment variant in which the process air is heated exclusively via the heat pump's condenser.

Dryer 1 shown in FIG. 1 has a drum, rotatable around a horizontal axis, as drying chamber 3 within which are secured carriers 4 for moving the laundry while the drum is rotating. Process air is ducted by means of a first fan 19 through a drum 3 and a heat pump 13, 14, 15, 17 in an air duct 2 in the closed circuit (process-air circuit 2). The process air heated in a condenser 15 of heat pump 13, 14, 15, 17 is cooled after passing through drum 3 and absorbing moisture and is heated again by condenser 15 after the moisture contained in the process air has been condensed. Heated air is therein ducted into drum 3 from behind, which is to say from a side of drum 3 opposite a door 5 through said drum's perforated base, hence making contact there with the laundry requiring to be dried, and flows through the loading opening of drum 3 to a lint filter 6 inside a door 5 sealing the loading opening. The air current is then diverted downward in door 5 and ducted in air duct 2 to evaporator 13 of heat pump 13, 14, 15, 17, where it is cooled. The condensate produced therein is captured in a condensate container 29 from where it can be disposed of by emptying or pumping away. The coolant of heat pump 13, 14, 15, 17 evaporated in evaporator 13 is ducted to condenser 15 via a compressor 14. The coolant condenses in condenser 15 and in so doing emits heat into the process air. The coolant now present in liquid form is then ducted to an additional heat exchanger 16, which together with a second fan 20 is located in a cooling-air duct 12, and from there via a throttle valve 17 back to evaporator 13, as a result of which the coolant circuit will have been closed. The cooling air is taken from the ambient air and fed back to the ambient air after heat exchanging.

Drum 3 is mounted in the embodiment variant shown in FIG. 1 on the back base by means of a pivot bearing and at the front by means of an end shield 7, with drum 3 being supported by a brim on a glide strip 8 on the end shield 7 and thus held at the front end. The condensation dryer is controlled via a controller 10 that can be regulated by the user via a control unit 9.

Alongside controller 10 or integrated in controller 10, condensation dryer 1 includes first means 26 for determining a temperature difference $\Delta T=(T_K^1-T_K^2)$ between a first temperature $T_K^1$ of the coolant and a second temperature $T_K^2$ of the coolant measured after a period of time $\Delta t_1$ and for comparing $\Delta T$ with a limiting temperature difference $\Delta T_K^{lim}$ stored in controller 10; a counting device 27 for ascertaining a number n of cases in which $\Delta T$ is greater than or equal to $\Delta T_K^{lim}$, and second means 28 for comparing the number n with a prespecified limiting number $T_{lim}$ stored in controller 10 and for evaluating the difference, formed as $\Delta n=(n-n_{lim})$, with respect to the presence of an impermissible operating state.

23 signifies the outlet of condenser 15. 24 signifies the outlet of compressor 14. In the embodiment variant shown in FIG. 1 a temperature sensor 22 is arranged at each of outlets 23 and 24. Each of said temperature sensors 22 can be used within the scope of the above monitoring process, possibly also both temperature sensors 22 jointly with respectively correspondingly assigned limiting temperature differences.

A visual display means 25 serves to display an impermissible operating state, with it being possible for different colors to display different impermissible operating states.

Figure 2:
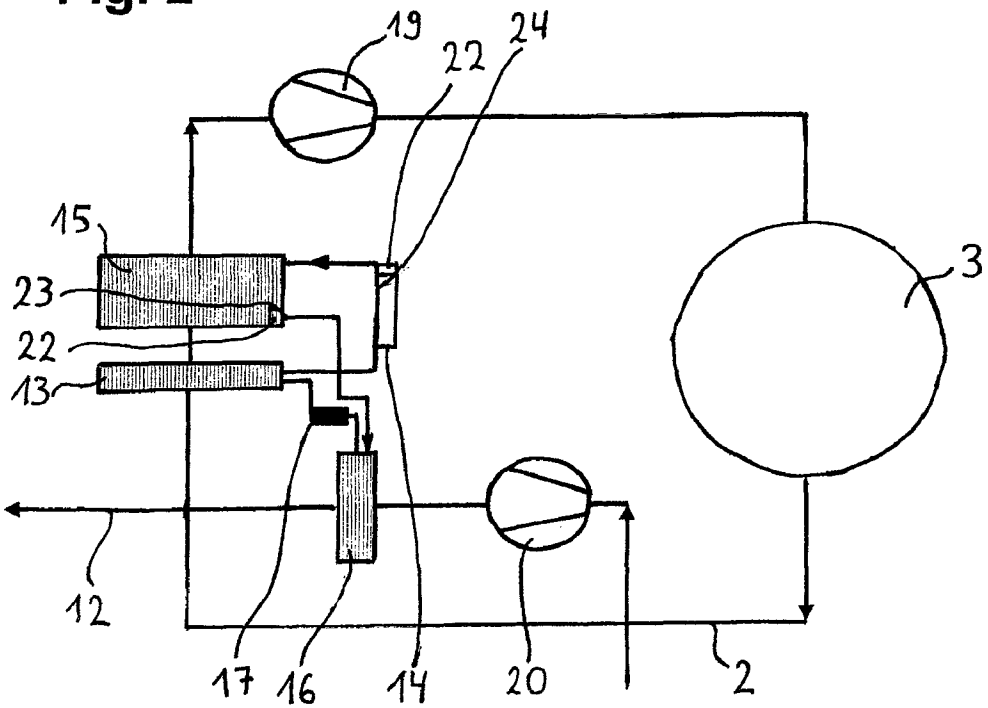
FIG. 2 is a schematic of the process-air circuit and heat pump for the first embodiment variant shown in FIG. 1.

FIG. 2 is a schematic of the process-air circuit and heat pump 13, 14, 15, 17 for the condensation dryer's first embodiment variant shown in FIG. 1. While the process air is being ducted in closed process-air circuit 2 and the coolant is being ducted in the closed circuit in heat pump 13, 14, 15, 17, the air used by means of second fan 20 for cooling in additional heat exchanger 16 is taken from the ambient air and fed back to the ambient air after passing through additional heat exchanger 16.

Figure 3:
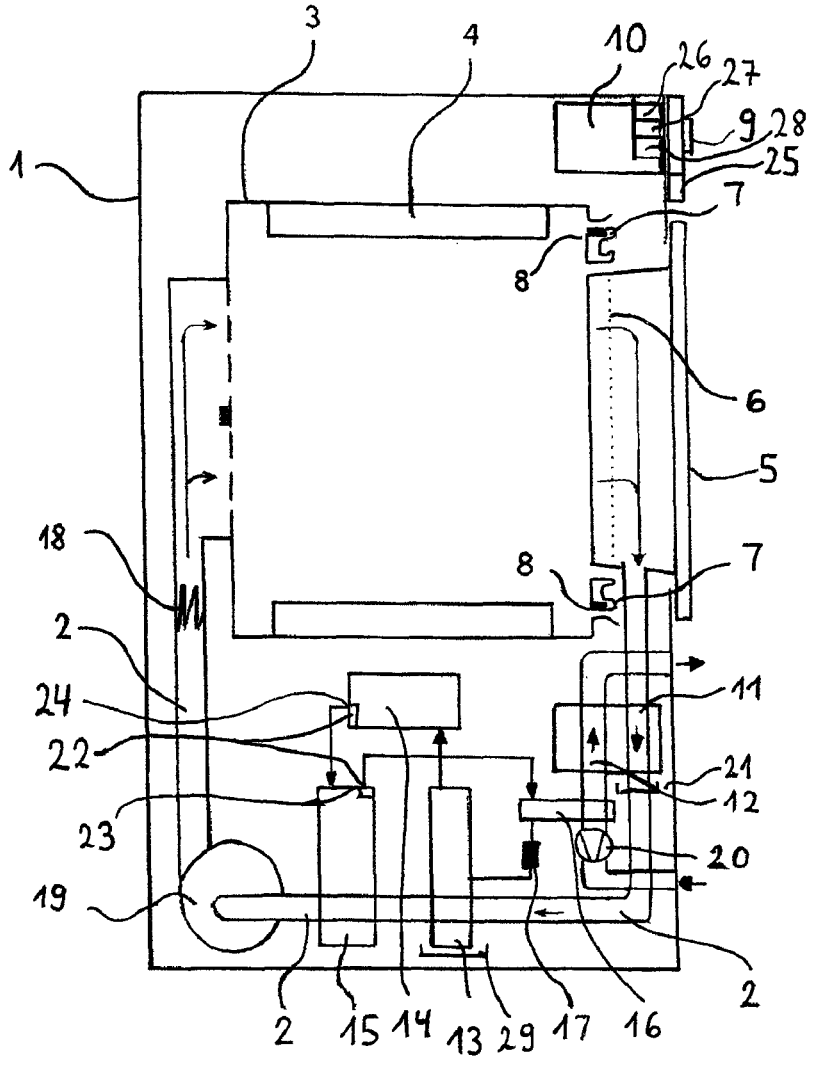
FIG. 3 shows a vertical section through a condensation dryer according to a second embodiment variant in which an additional heater and an additional air-air heat exchanger are used.

FIG. 3 shows a vertical section of a condensation dryer (abbreviated in the following to "dryer") according to a second embodiment variant in which there is an additional heat exchanger both in the heat pump and in the cooling-air duct of an air-air heat exchanger. An additional heater is also used in the embodiment variant shown in FIG. 3.

Dryer 1 shown in FIG. 3 has a drum, rotatable around a horizontal axis, as drying chamber 3 within which are secured carriers 4 for moving the laundry while the drum is rotating. Process air is ducted by means of a first fan 19 across a heater 18 through a drum 3, an air-air heat exchanger 11, 12, and a heat pump 13, 14, 15, 17 in an air duct 2 in the closed circuit (process-air circuit 2). The moist, warm process air is cooled after passing through drum 3 and is heated again after the moisture contained in the process air has been condensed. Air heated by heater 18 or, as the case may be, condenser 15 is therein ducted from behind, which is to say from a side of drum 3 opposite a door 5 through said drum's perforated base, makes contact there with the laundry requiring to be dried, and flows through the loading opening of drum 3 to a lint filter 6 inside a door 5 sealing the loading opening. The air current is then diverted downward in door 5 and ducted by air duct 2 to air-air heat exchanger 11, 12. The moisture absorbed from the laundry items by the process air condenses there at least partially as the result of cooling and is captured in condensate container 21 from where it can be disposed of. The somewhat cooled process air is then ducted to evaporator 13 of heat pump 13, 14, 15, 17 where it is further cooled, with the condensate accruing there being captured in condensate container 29 from where it can be disposed of by emptying or pumping away. The coolant of heat pump 13, 14, 15, 17 evaporated in evaporator 13 is ducted to condenser 15 via a compressor 14. The coolant condenses in condenser 15 and in so doing emits heat into the process air. The coolant now present in liquid form is then ducted to an additional heat exchanger 16 located in cooling-air duct 12 of air-air heat exchanger 11, 12 between that and a second fan 20, and from there via a throttle valve 17 back to evaporator 13, as a result of which the coolant circuit will have been closed. The cooling air is taken from the ambient air and fed back to the ambient air after passing through air-air heat exchanger 11, 12.

Drum 3 is mounted in the embodiment variant shown in FIG. 3 on the back base by means of a pivot bearing and at the front by means of an end shield 7, with drum 3 being supported by a brim on a glide strip 8 on the end shield 7 and thus held at the front end. The condensation dryer is controlled via a controller 10 that can be regulated by the user via a control unit 9.

Alongside controller 10 or integrated in controller 10, condensation dryer 1 includes first means 26 for determining a temperature difference $\Delta T=(T_K^1-T_K^2)$ between a first temperature $T_K^1$ of the coolant and a second temperature $T_K^2$ of the coolant measured after a period of time $\Delta t_1$ and for comparing $\Delta T$ with a limiting temperature difference $\Delta T_K^{lim}$ stored in controller 10; a counting device 27 for ascertaining a number n of cases in which $\Delta T \geqq \Delta T_K^{lim}$, and second means 28 for comparing the number n with a prespecified limiting number $n_{lim}$ stored in controller 10 and for evaluating the difference, formed as $\Delta n=(n-n_{lim})$, with respect to the presence of an impermissible operating state.

23 signifies the outlet of condenser 15. 24 signifies the outlet of compressor 14. In the embodiment variant shown in FIG. 3 a temperature sensor 22 is arranged at each of outlets 23 and 24. A visual display means 25 serves to display an impermissible operating state.

Figure 4:
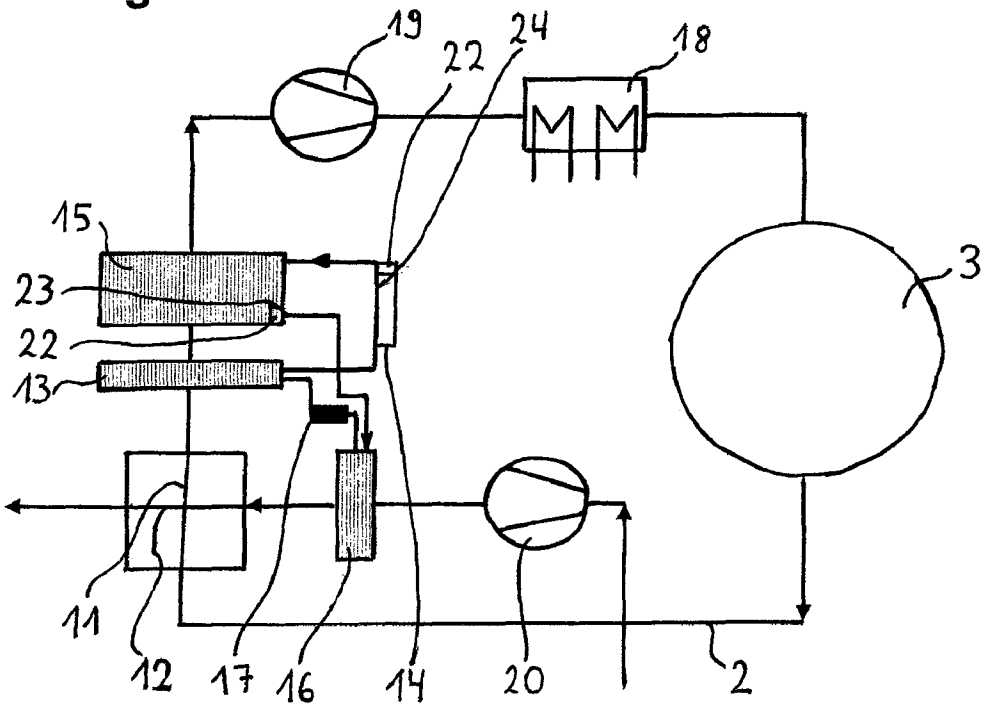
FIG. 4 is a schematic of the process-air circuit and heat pump for the second embodiment variant shown in FIG. 3.

FIG. 4 is a schematic of the process-air circuit and the heat-pump circuit for the second embodiment variant shown in FIG. 3. While the process air is being ducted in closed process-air circuit 2 and the coolant is being ducted in the closed circuit of heat pump 13, 14, 15, 17, the air used for cooling in air-air heat exchanger 11, 12 is taken from the ambient air, ducted to air-air heat exchanger 11,12 via second fan 20 after passing through additional heat exchanger 16, and then fed back to the ambient air.

Figure 5:
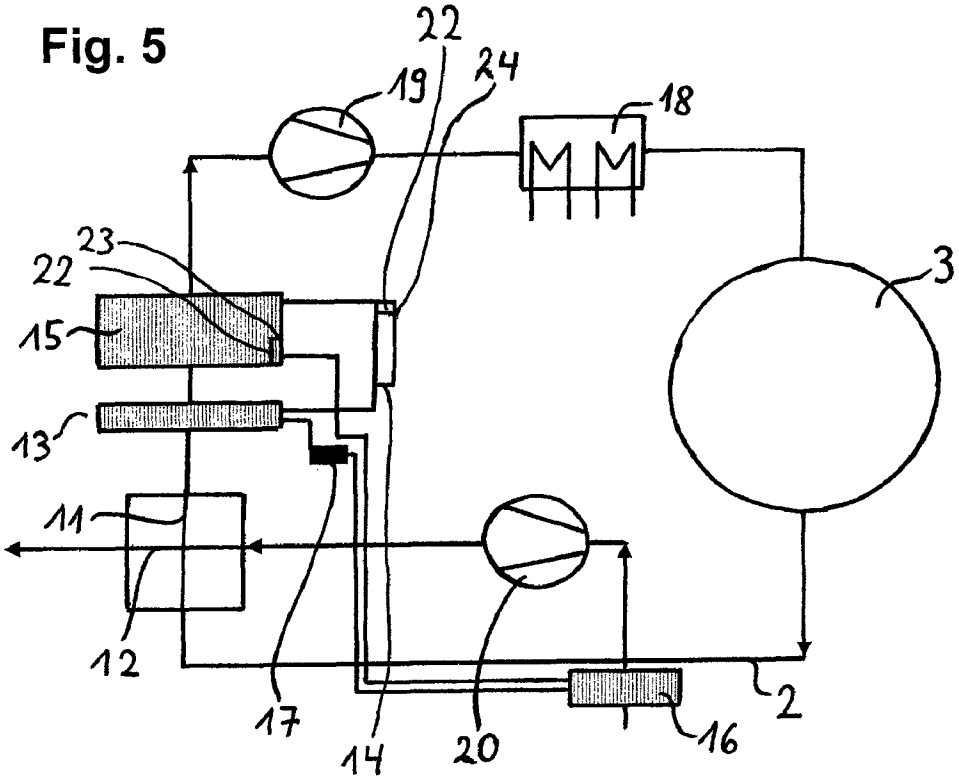
FIG. 5 is a schematic of the process-air circuit and heat pump for a third embodiment variant.

FIG. 5 is a schematic of the process-air circuit and heat-pump circuit for a third embodiment variant of the condensation dryer. In that embodiment variant additional heat exchanger 16 is located in cooling-air duct 12 on the side facing away from air-air heat exchanger 11, 12 of second fan 20. Heat exchanger 16 is thus located in the cooling air's intake region.

The invention claimed is:

1. A condensation dryer, comprising:
a drying chamber for items to be dried;
a process-air circuit;
a first fan in the process-air circuit;
a heat pump in which a coolant circulates;
an evaporator;
a compressor;
a condenser;
a throttle;
a temperature sensor to measure a temperature of the coolant;
a controller to store a limiting temperature difference, a prespecified limiting number, and a prespecified value;
a first comparator to determine a temperature difference between a first temperature of the coolant and a second temperature of the coolant that is measured after a first predetermined period of time and to compare the temperature difference with the limiting temperature difference stored in the controller;
a counter to ascertain a number of occurrences in which the temperature difference is greater than or equal to the limiting temperature difference; and
a second comparator to compare the number of occurrences in which the temperature difference is greater than or equal to the limiting temperature difference with the prespecified limiting number stored in the controller and to evaluate a number difference between the number of occurrences in which the temperature difference is greater than or equal to the limiting temperature difference and the prespecified limiting number with respect to the presence of an impermissible operating state;
wherein a first impermissible operating state is indicated if the number difference is greater than or equal to the prespecified value stored in the controller.

2. The condensation dryer of claim 1, wherein the second comparator resets the number of occurrences ascertained by the counter to zero if the number difference is not greater than or equal to zero within a second predetermined period of time in the controller.

3. The condensation dryer of claim 1, wherein the temperature sensor is on one of an outlet of the condenser and an outlet of the compressor.

4. The condensation dryer of claim 1, further comprising a heat exchanger in the heat pump.

5. The condensation dryer of claim 4, further comprising a process-air channel between the evaporator and the condenser, wherein the heat exchanger is in the process-air channel.

6. The condensation dryer of claim 4, further comprising a cooling-air channel, wherein the heat exchanger is in the cooling-air channel.

7. The condensation dryer of claim 1, further comprising a second fan to cool the heat pump.

8. The condensation dryer of claim 7, further comprising a cooling-air channel, wherein the second fan is in at least one of the cooling-air channel and a predetermined vicinity of the compressor.

9. The condensation dryer of claim 1, further comprising at least one of an acoustic and a visual display to indicate the impermissible operating state.

10. A method for operating a condensation dryer having a drying chamber for items requiring to be dried, a process-air circuit, a first fan in the process-air circuit, a heat pump in which a coolant circulates, an evaporator, a compressor, a condenser, a throttle, and a temperature sensor to measure a temperature of the coolant, the method comprising:
determining a temperature difference between a first temperature of the coolant of the coolant and a second temperature of the coolant measured by the temperature sensor after the predetermined period of time;
comparing the temperature difference with a limiting temperature difference stored in a controller;
incrementing a number of occurrences in a counter by one whenever the temperature difference is greater than or equal to the limiting temperature difference;
comparing the number of occurrences with s prespecified limiting number stored in the controller; and
evaluating a number difference between the number of occurrences in which the temperature difference is greater than or equal to the limiting difference and the prespecified limiting number with respect to the presence of an impermissible operating state; and
indicating a first impermissible operating state if the number difference is greater than or equal to a first prespecified value stored in the controller.

11. The method of claim 10, wherein the indicating of the first impermissible operating state includes a request to clean air paths in the condensation dryer.

12. The method of claim 10, further comprising indicating a second impermissible operating state if the number difference is greater than or equal to a second prespecified value stored in the controller.

13. The method of claim 12, wherein, in addition to the indicating of the second impermissible operating state, a drying process in progress is interrupted.

* * * * *